US007884294B2

(12) United States Patent
Chou

(10) Patent No.: US 7,884,294 B2
(45) Date of Patent: Feb. 8, 2011

(54) ROLLING-BALL SWITCH

(76) Inventor: Tien-Ming Chou, No.41, San-Hsi 5th St., Taichung City (TW)

( * ) Notice: Subject to any disclaimer, the term of this patent is extended or adjusted under 35 U.S.C. 154(b) by 50 days.

(21) Appl. No.: 12/418,085

(22) Filed: Apr. 3, 2009

(65) Prior Publication Data

US 2010/0133075 A1 Jun. 3, 2010

(30) Foreign Application Priority Data

Dec. 3, 2008 (TW) ..... 97146920 A

(51) Int. Cl.
*H01H 1/06* (2006.01)

(52) U.S. Cl. ..... 200/277

(58) Field of Classification Search ..... 200/277, 200/1 R, 61.11, 61.45 M, 61.45 R, 61.52, 200/84 R, 220, 193, 229, 52 R, 215
See application file for complete search history.

(56) References Cited

U.S. PATENT DOCUMENTS 2,310,163 A * 2/1943 Moxey ..... 340/323 R
2,339,063 A * 1/1944 Deakin ..... 335/124
5,034,620 A * 7/1991 Cameron ..... 307/10.7

* cited by examiner

*Primary Examiner*—Edwin A. Leon
(74) *Attorney, Agent, or Firm*—Frommer Lawrence & Haug LLP; Ronald R. Santucci

(57) ABSTRACT

A rolling-ball switch includes a housing defining at least two receiving sections, at least one separating member provided in the housing between the two receiving sections, at least two conductive balls disposed rollably and respectively in the receiving sections, a pair of first terminals extending into one of the receiving sections to contact one of the conductive balls, and a pair of second terminals extending into the other one of the receiving sections to contact the other one of the conductive balls. The conductive balls are rollable toward the respective pairs of the first and second terminals in a first direction. The separating member prevents movement of the conductive balls from one of the receiving sections to the other one of the receiving sections.

8 Claims, 11 Drawing Sheets

ROLLING-BALL SWITCH

CROSS-REFERENCE TO RELATED APPLICATION

This application claims priority of Taiwanese Application No. 097146920, filed on Dec. 3, 2008, the disclosure of which is incorporated herein by reference.

BACKGROUND OF THE INVENTION

1. Field of the Invention

This invention relates to a switch, more particularly to a rolling-ball switch.

2. Description of the Related Art

Referring to FIG. 1, a conventional ball-vibration switch 10, as disclosed in Taiwanese Patent No. 184124, includes a housing having a casing part 11 and a plate part 14 cooperatively defining a receiving space 15, four spaced-apart terminals 12 extending into the receiving space 15, and a conductive ball 13 disposed in the receiving space 15 to contact the terminals 12.

In use, the conductive ball 13 contacts simultaneously the terminals 12 so as to place the conventional switch 10 in an "ON" state. When an external force is applied to the switch 10 so that the conductive ball 13 moves away from one of the terminals 12, the switch 10 is shifted from the "ON" state to an "OFF" state. Hence, the conductive ball 13 quickly produces a highly sensitive switching operation, and ON/OFF control of the conventional ball-vibration switch 10 can be effectively attained.

However, since the conductive ball 13 is small and is lightweight, it is possible that the conductive ball 13 may not contact simultaneously the four terminals 12, so that dependable operation of the switch 10 cannot be ensured. Further, the aforementioned conventional ball-vibration switch 10 is only suitable for use in a vibration-sensing device, and is not suitable for use when tilting of an electronic appliance must be detected. Hence, use of the conventional ball-vibration switch 10 is limited.

SUMMARY OF THE INVENTION

Therefore, the object of the present invention is to provide a rolling-ball switch that is capable of overcoming the aforementioned drawbacks of the prior art.

According to this invention, a rolling-ball switch comprises a housing defining at least two receiving sections, at least one separating member provided in the housing between the two receiving sections, at least two conductive balls disposed rollably and respectively in the receiving sections, a pair of first terminals extending into one of the receiving sections to contact one of the conductive balls, and a pair of second terminals extending into the other one of the receiving sections to contact the other one of the conductive balls. The conductive balls are rollable toward the respective pairs of the first and second terminals in a first direction. The separating member prevents movement of the conductive balls from one of the receiving sections to the other one of the receiving sections.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
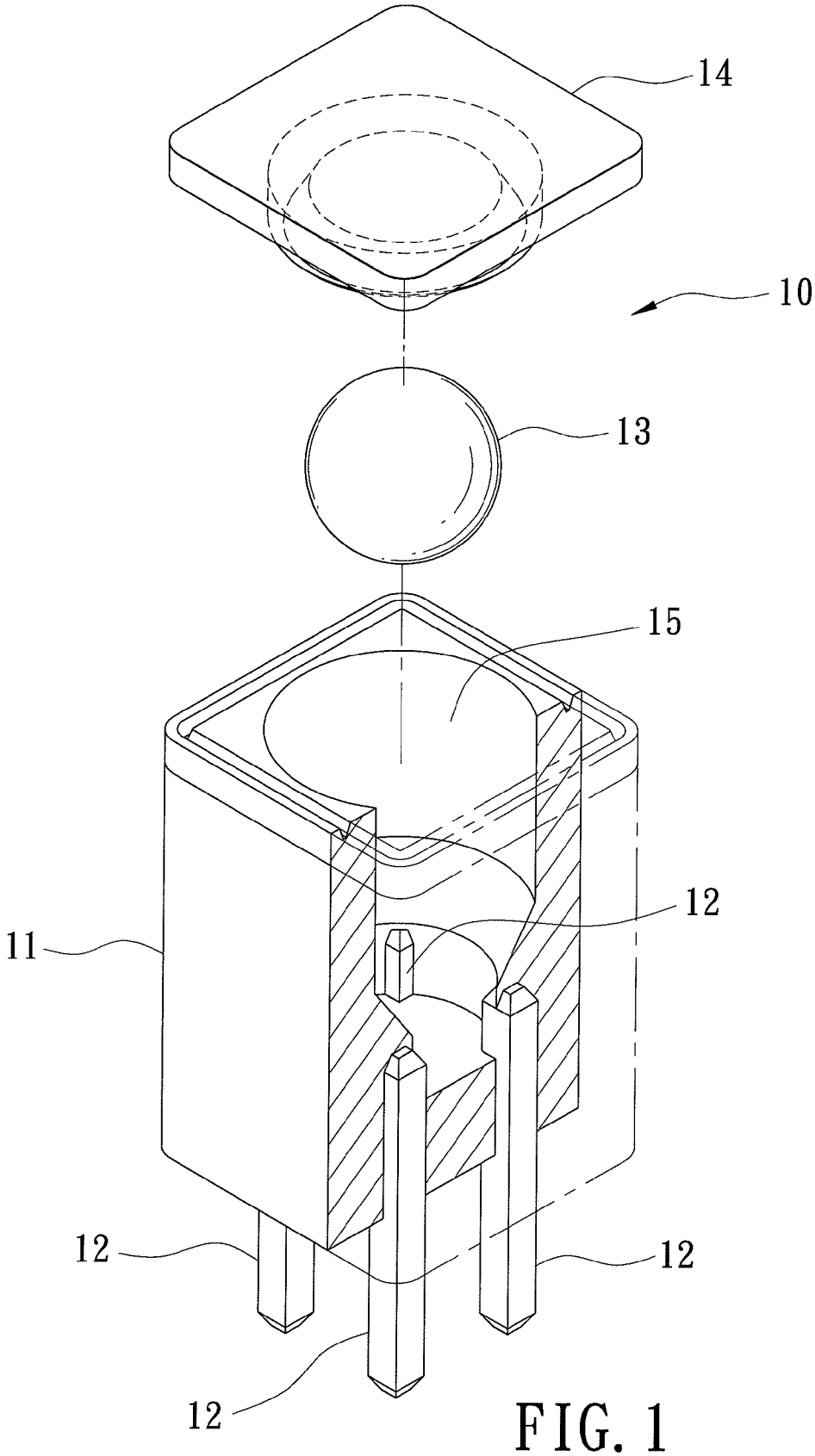
FIG. 1 PRIOR ART
FIG. 1 is an exploded perspective view of a ball-vibration switch disclosed in Taiwanese Patent No. 184124, with a casing part thereof sectioned for clarity's sake.
Figure 2:
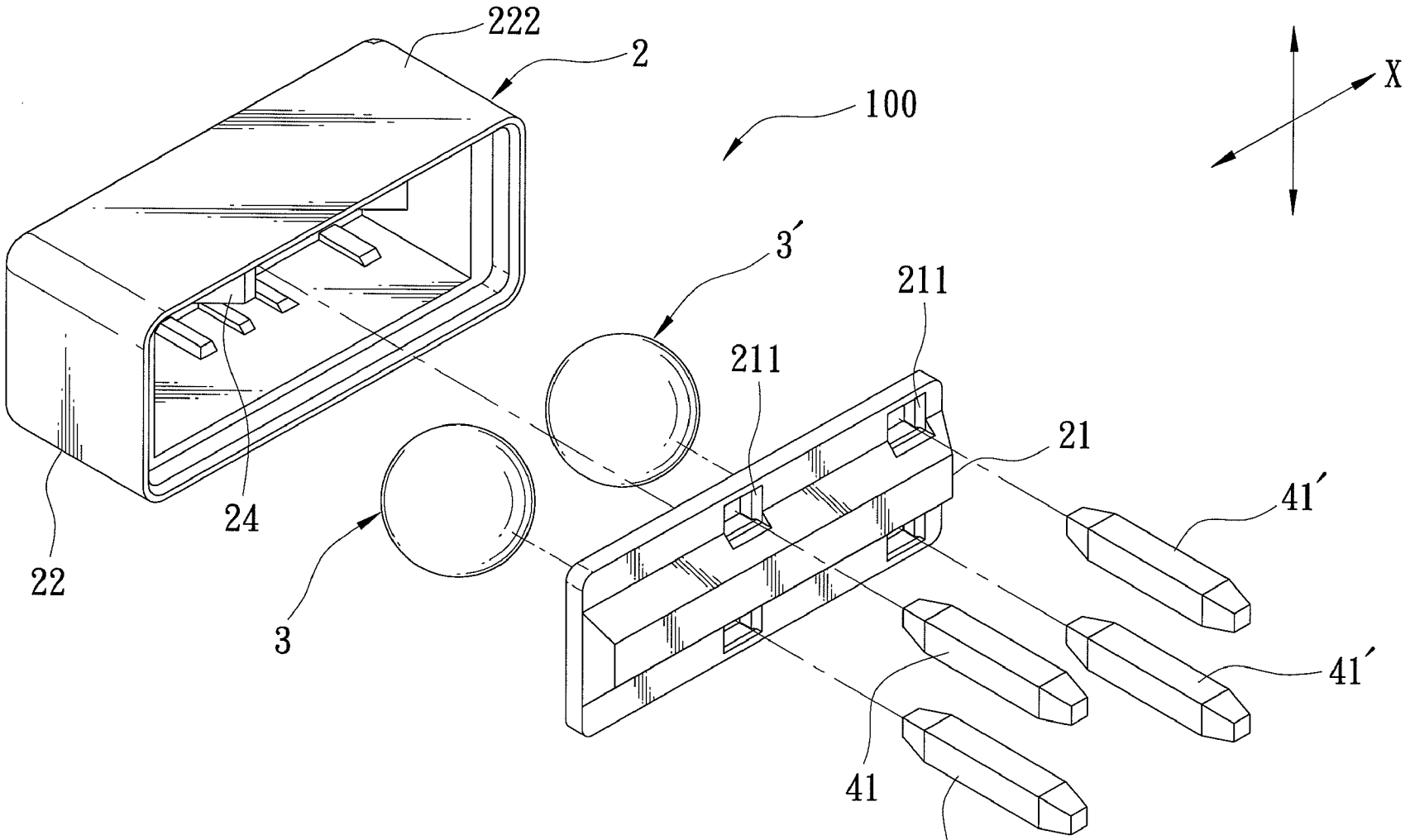
FIG. 2 is an exploded perspective view of a rolling-ball switch according to the first preferred embodiment of this invention.
Figure 3:
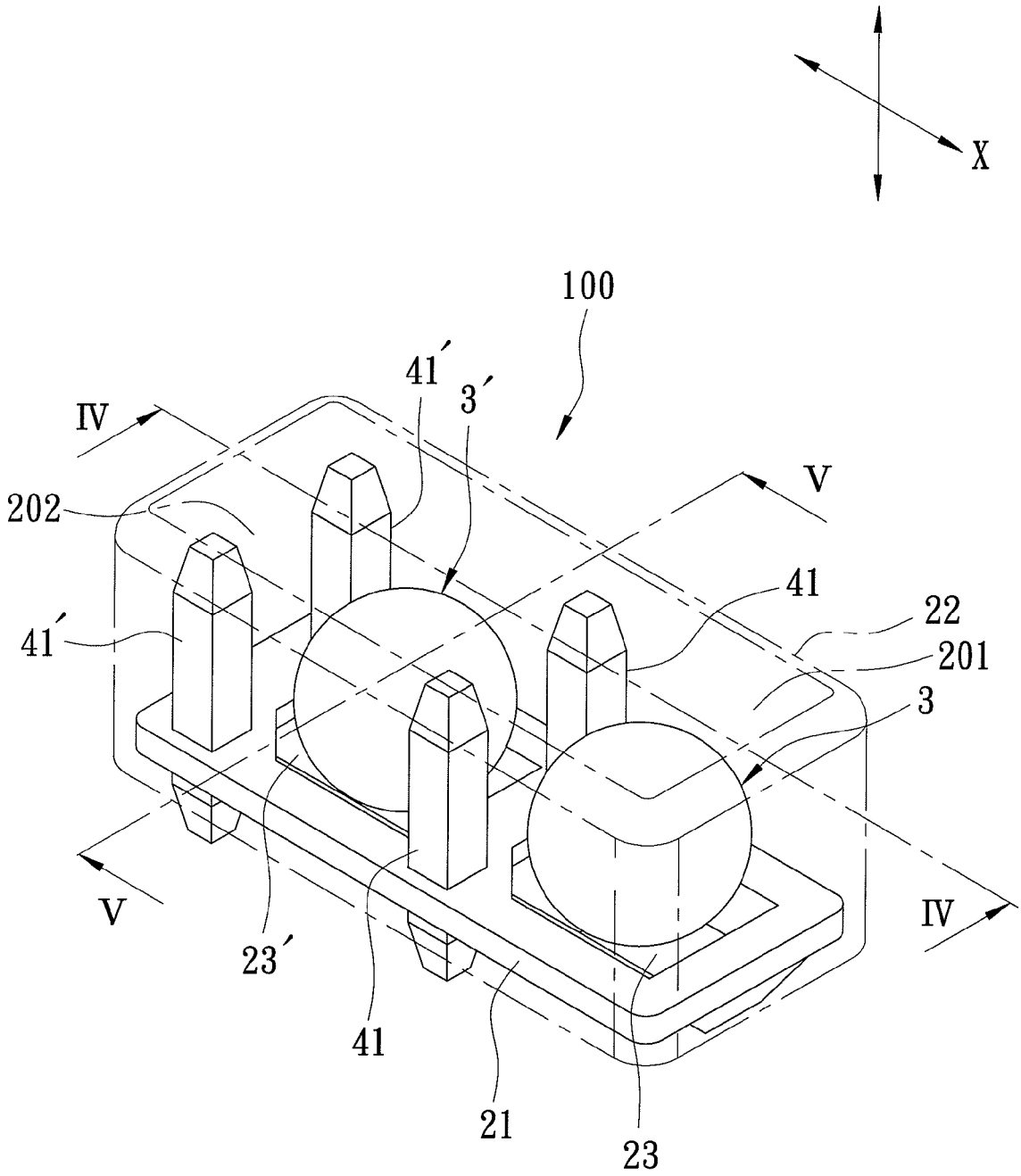
FIG. 3 is a perspective view of the first preferred embodiment in an assembled state.

Before the present invention is described in greater detail, it should be noted that the same reference numerals have been used to denote like elements throughout the specification.

Referring to FIGS. 2 to 6, a rolling-ball switch 100 according to the first preferred embodiment of the present invention is shown to comprise a housing 2, two conductive balls 3, 3', a pair of first terminals 41, and a pair of second terminals 41'.

The housing 2 is made of plastic, and includes a casing part 22, and a plate part 21 that serves as a bottom wall of the housing 2 and that is connected to and that cooperates with the casing part 22 to define two receiving sections 201, 202. The plate part 21 has an inner surface 210 formed with two holding grooves 23, 23' disposed respectively in the receiving sections 201, 202, an outer surface 212, and two pairs of spaced-apart through holes 211 extending through the inner and outer surfaces 210, 212 thereof and surrounding the holding groove 23'. Each holding groove 23, 23' has a groove bottom wall with a slanting surface 230, 230'. The slanting surface 230, 230' has opposite first and second ends 231, 232, 231', 232'. The first end 231, 231' is spaced apart from the inner surface 210 at a distance smaller than a distance between the second end 232, 232' and the inner surface 210, i.e., the slanting surface 230, 230' slants downwardly from the first end 231, 231' to the second end 232, 232'.

The casing part 22 has a top wall 221, and a surrounding wall 222 extending downwardly from the top wall 221 and connected to the casing part 21. In this embodiment, a separating member 24 projects downwardly from the top wall 221 between the receiving sections 201, 202. The conductive balls 3, 3' are disposed rollably and respectively in the receiving sections 201, 202, and are respectively movable along the slanting surfaces 230, 230' of the holding grooves 23, 23'.

The first terminals 41 extend into the receiving section 201 through a respective pair of the through holes 211 in the plate part 21, are spaced apart from each other at a distance smaller than a diameter of the conductive ball 3, and are disposed proximate to the first end 231 of the slanting surface 230.

The second terminals 41' extend into the receiving section 202 through another respective pair of the through holes 211 in the plate part 21, are spaced apart from each other at a distance smaller than a diameter of the conductive ball 3', and are disposed proximate to the first end 231' of the slanting surface 230'. The conductive balls 3, 3' are rollable toward the respective pairs of the first and second terminals 41, 41' in a first direction (X), and are proximate to the second ends 232, 232' of the slanting surfaces 230, 230' of the respective holding grooves 23, 23' when moving away from the respective pairs of the first and second terminals 41, 41'.

Figure 4:
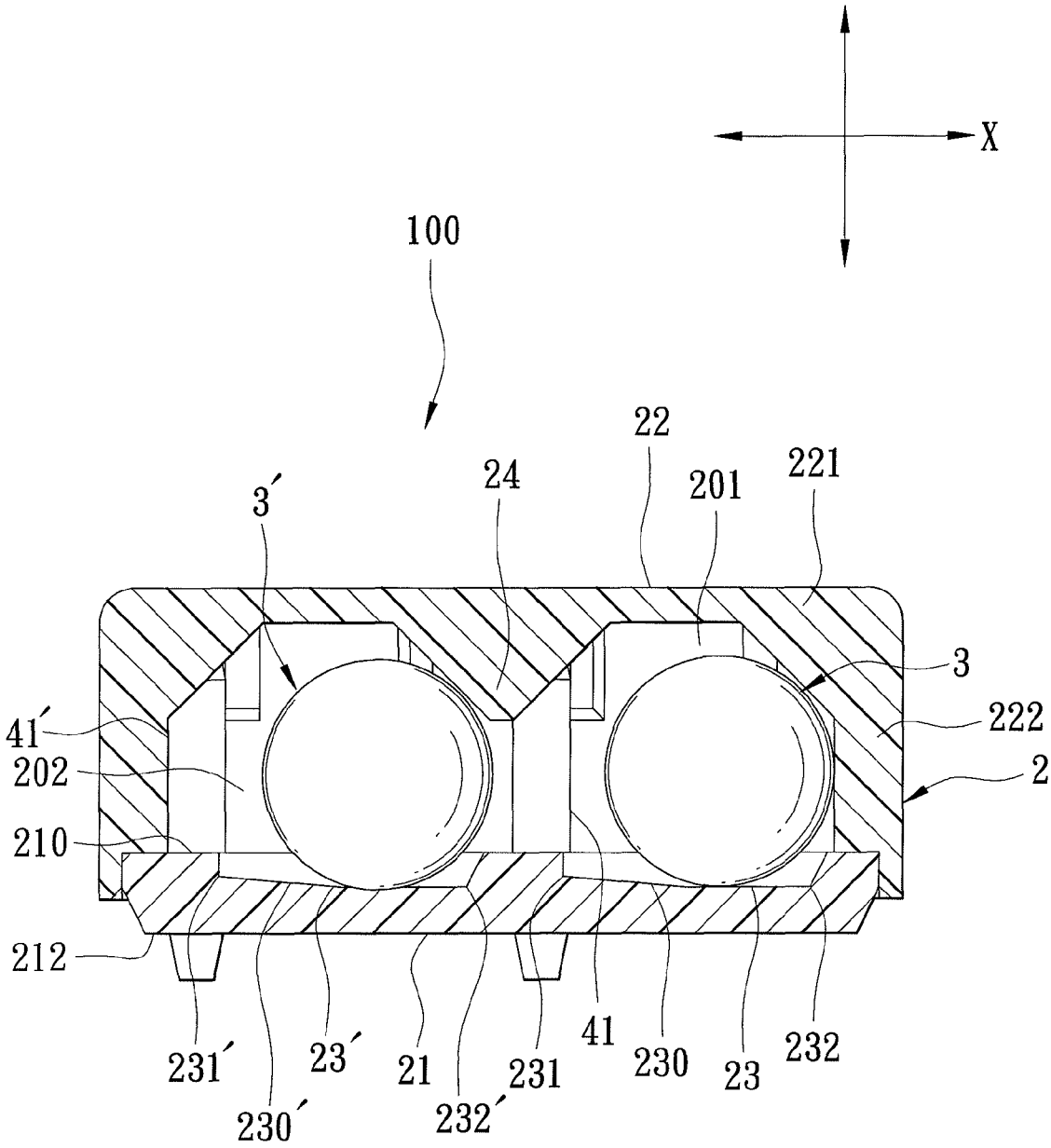
FIG. 4 is a sectional view of the first preferred embodiment taken along line IV-IV of FIG. 3.
Figure 5:
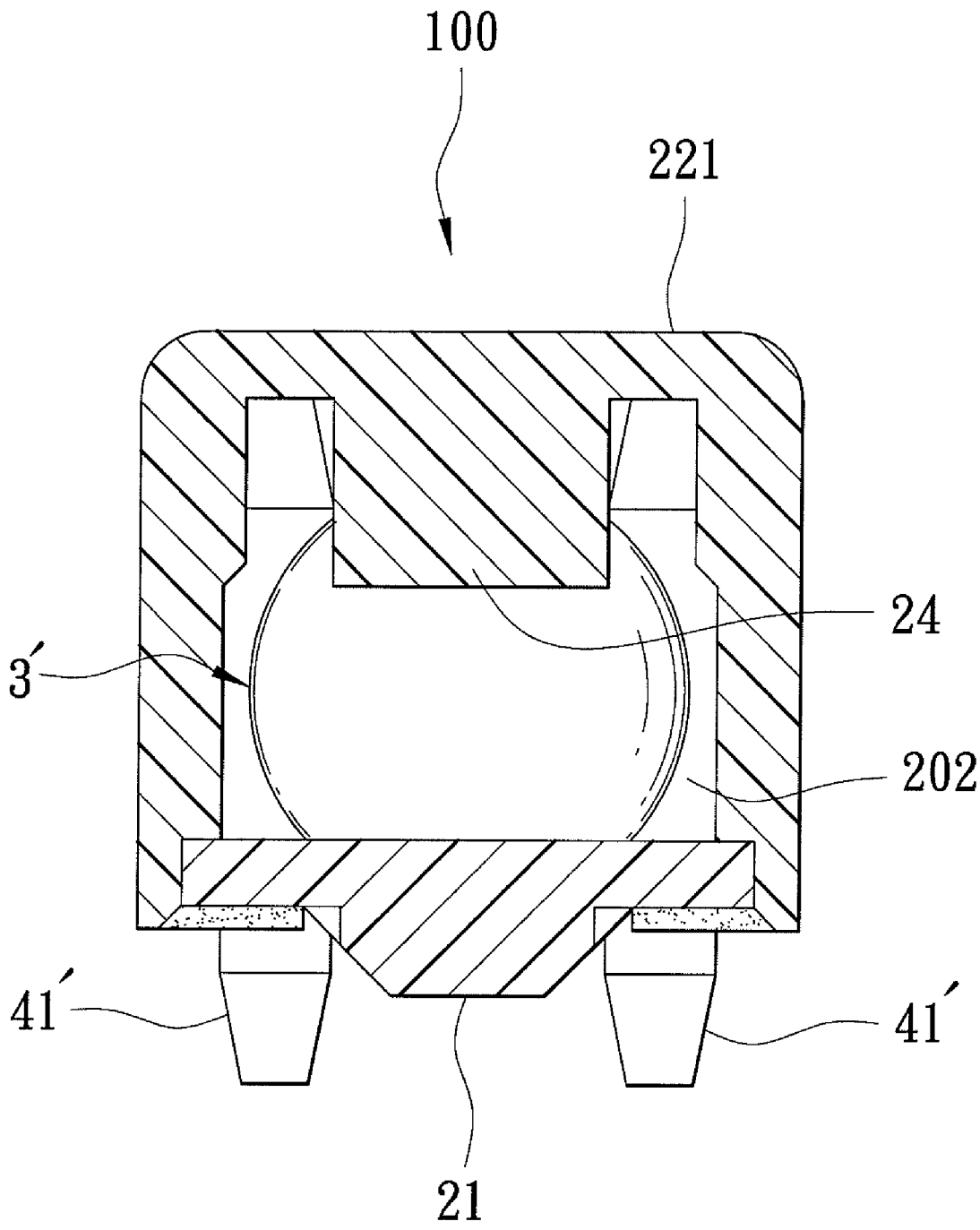
FIG. 5 is a sectional view of the first preferred embodiment taken along line V-V of FIG. 3.

With reference to FIGS. 4 and 5, in the absence of an external force, the conductive balls 3, 3' rest in proximity to the second ends 232, 232' of the slanting surfaces 230, 230' of the respective holding grooves 23, 23', and are spaced apart from the respective pairs of the first and second terminals 41, 41'. The separating member 24 prevents the conductive balls 3, 3' from rolling from one of the receiving sections 201, 202 to the other one of the receiving sections 201, 202. The switch 100 is OFF in this state.

Figure 6:
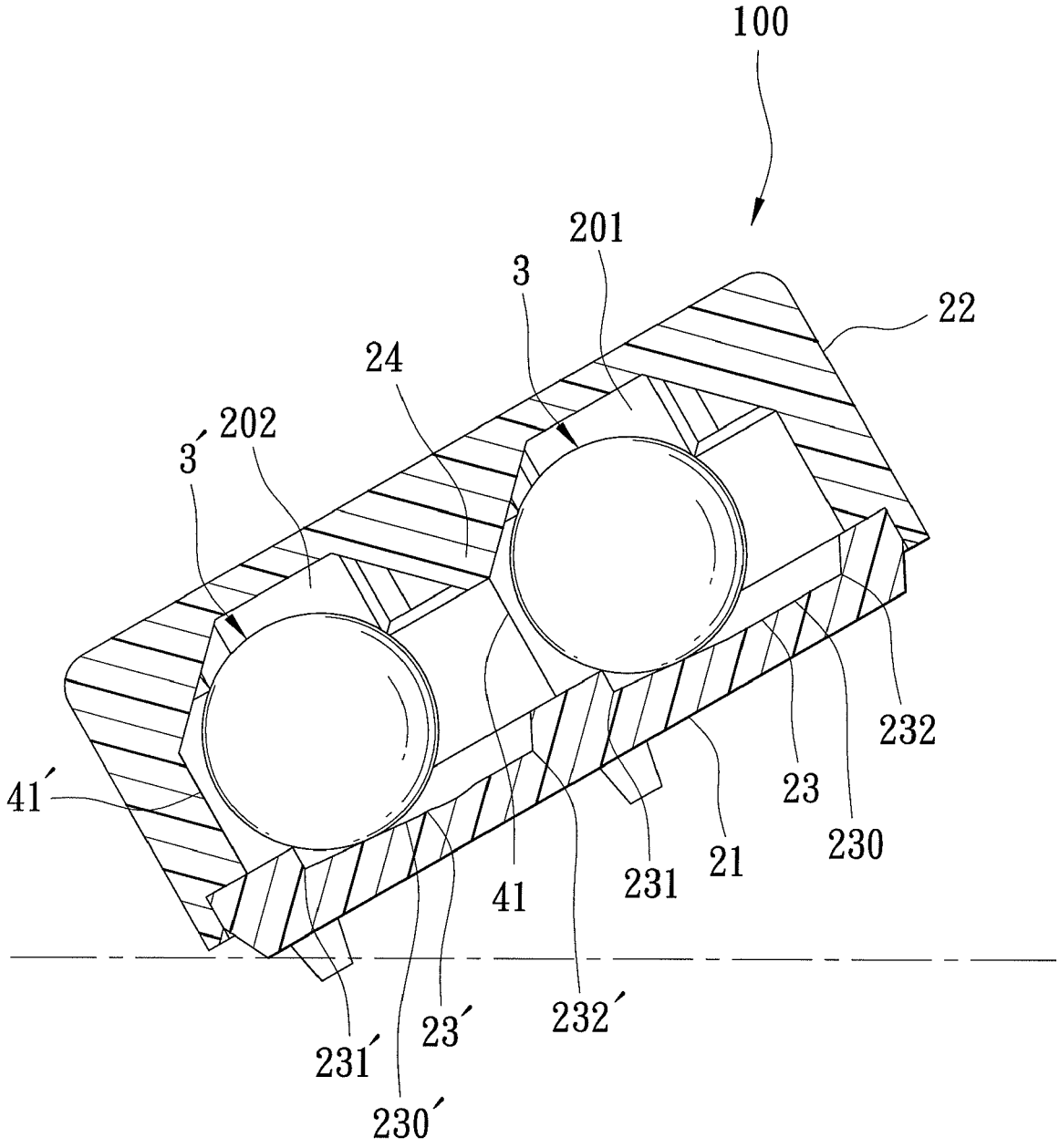
FIG. 6 is a sectional view of the first preferred embodiment in an ON state.

With reference to FIG. 6, when the switch 100 is tilted, the conductive balls 3, 3' roll within the respective receiving sections 201, 202 from the second ends 232, 232' to the first ends 231, 231' of the respective holding grooves 23, 23', so that the conductive balls 3, 3' contact the respective pairs of the first and second terminals 41, 41', thereby shifting the switch 100 from the OFF state to an ON state.

In this embodiment, the conductive balls 3, 3' are described as contacting simultaneously the respective pairs of the first and second terminals 41, 41' so as to place the switch 100 in the ON state. However, it is to be noted that the switch 100 may be placed in an ON state in this embodiment even if only one of the conductive balls 3, 3' is in contact with the respective pair of the first and second terminals 41, 41'.

According to the aforesaid description, for example, if the conduction failure rate of one conductive ball and a pair of the terminals for the typical rolling-ball switch is 10%, the conduction failure rate of the present invention with two conductive balls 3, 3' and two pairs of the first and second terminals 41, 41' can then be lowered by 1% ($0.1\times0.1=0.01$), with the conduction rate being estimated to reach more than 96%. Hence, the conduction rate of the present invention is effectively enhanced.

It is worth mentioning that by varying the degree of inclination of the slanting surfaces 230, 230' in the respective holding grooves 23, 23', the switch 100 according to the first preferred embodiment of the present invention may be used in various appliances that require automatic switching OFF when tilted to a predetermined angle, such as an electric iron, a floor lamp, a stand fan, an electric heater, a humidifier, a mosquito light, etc., so that risk of electrical fire can be avoided.

Figure 7:
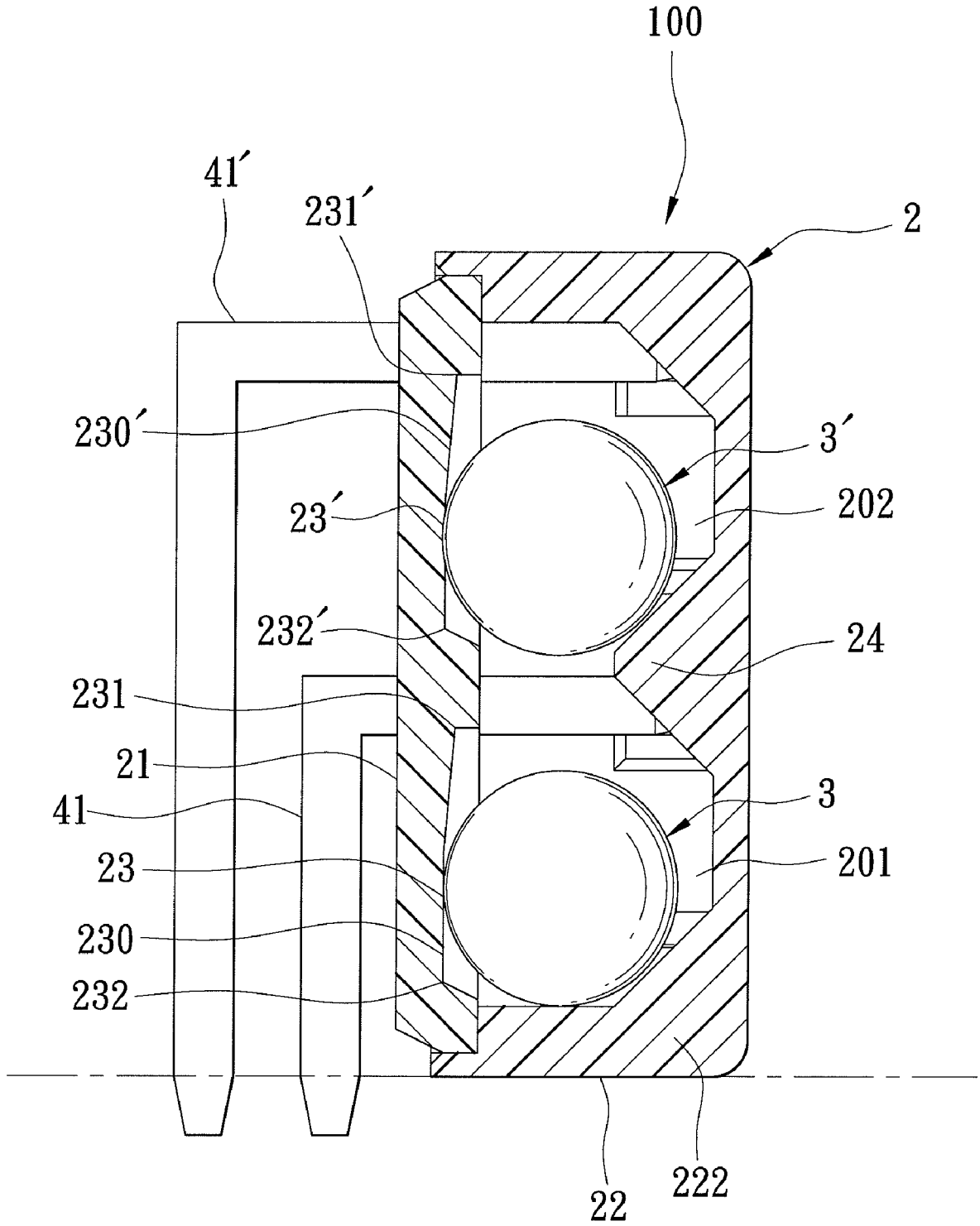
FIG. 7 is a sectional view of a rolling-ball switch according to the second preferred embodiment of this invention.

Referring to FIG. 7, a rolling-ball switch 100 according to the second preferred embodiment of the present invention is shown to be similar to the first preferred embodiment. However, in this embodiment, the housing 2 is disposed vertically along a reference horizontal line, such that the receiving section 202 is disposed above the receiving section 201. In the absence of an external force, the conductive balls 3, 3' are similarly disposed in proximity to the second ends 232, 232' of the slanting surfaces 230, 230', the conductive ball 3 abuts against the surrounding wall 222, and the conductive ball 3' is prevented from rolling to the receiving section 201 and from contacting the first terminals 41 by the separating member 24, thereby placing the switch 100 in an OFF state. When an external force is applied to the switch 100 so that the switch 100 rotates to an angle greater than 90°, the conductive balls 3, 3' similarly roll from the second ends 232, 232' to the first ends 231, 231' of the respective holding grooves 23, 23', and contact respectively the pairs of the first and second terminals 41, 41', thereby shifting the switch 100 from the OFF state to an ON state.

It is worth mentioning that the switch 100 according to the second preferred embodiment of the present invention may be used in various appliances that require detection of horizontal and vertical signals, such as a liquid crystal display (LCD), an electronic compass, etc. In the case of the LCD, for example, when the conductive balls 3, 3' are disposed in proximity to the second ends 232, 232' of the respective holding grooves 23, 23', the screen displays a vertical picture. When the conductive balls 3, 3' are disposed in proximity to the first ends 231, 231' of the respective holding grooves 23, 23', the screen displays a horizontal picture.

Figure 8:
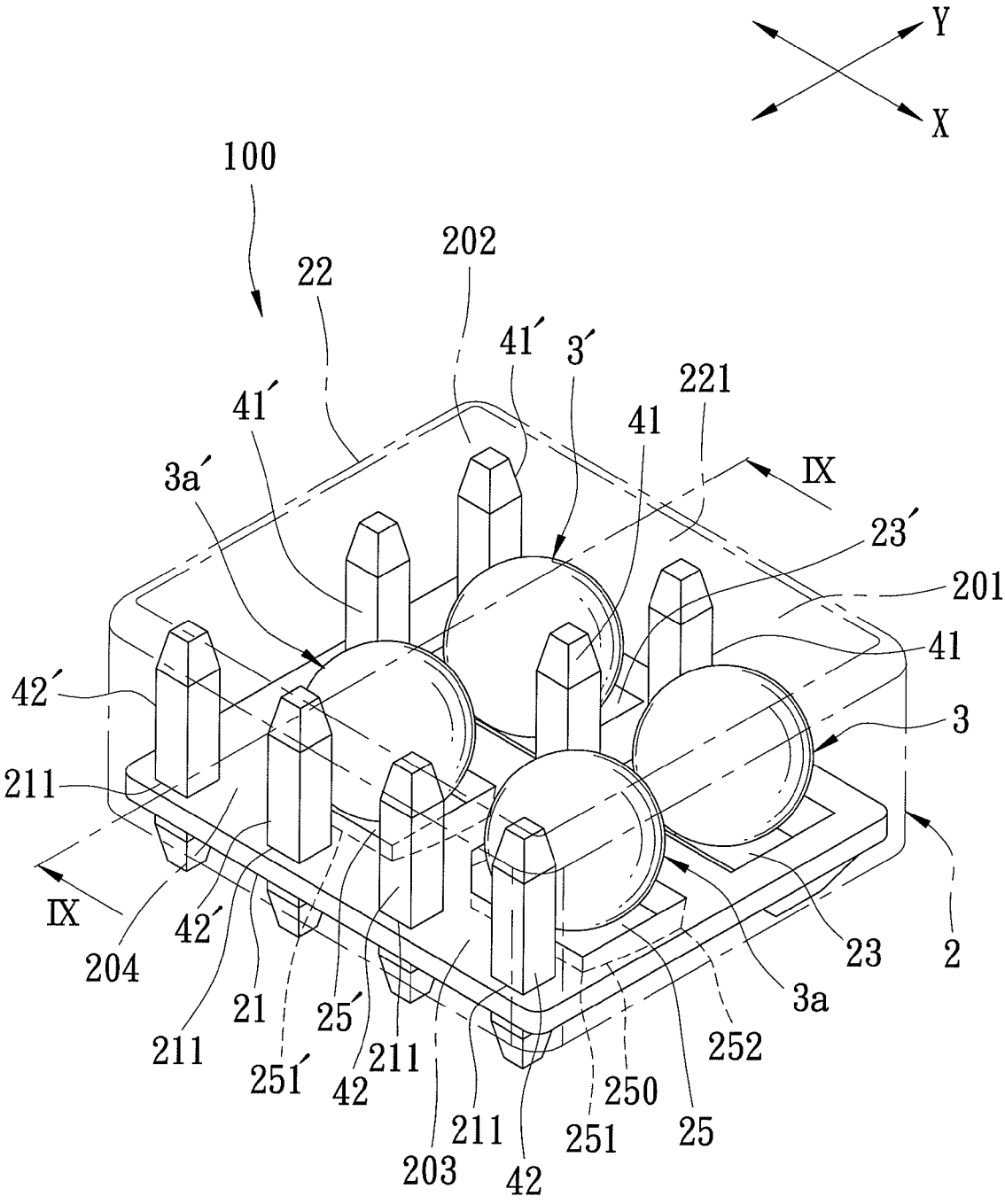
FIG. 8 is a perspective view of a rolling-ball switch according to the third preferred embodiment of this invention.
Figure 9:
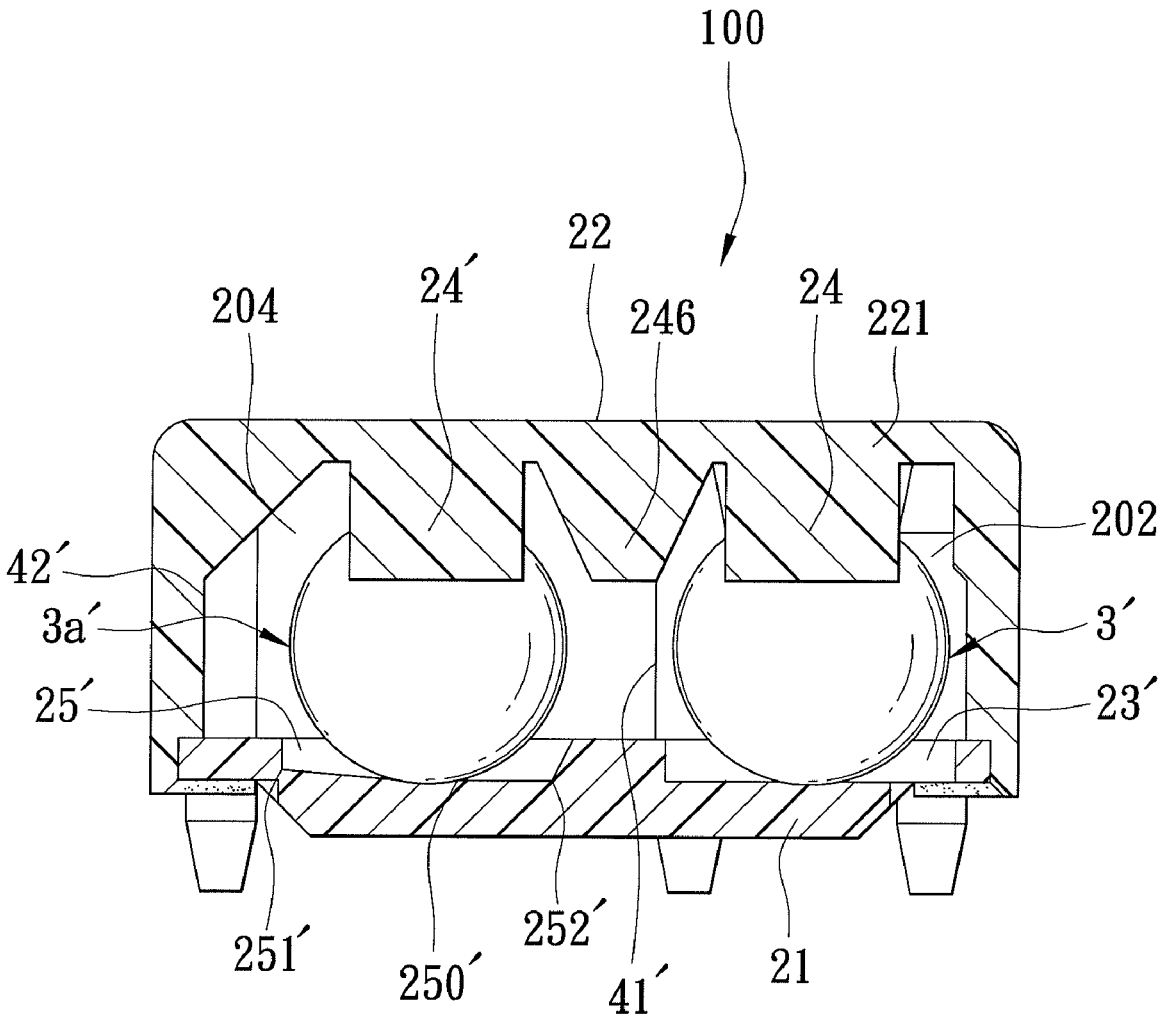
FIG. 9 is a sectional view of the third preferred embodiment taken along line IX-IX of FIG. 8.

Referring to FIGS. 8 and 9, a rolling-ball switch 100 according to the third preferred embodiment of the present invention is shown to be similar to the first preferred embodiment. However, in this embodiment, the housing 2 further defines two additional receiving sections 203, 204 adjacent respectively to the receiving sections 201, 202. A separating member 24' projects downwardly from the top wall 221 between the receiving sections 203, 204, a separating member (not shown) projects downwardly from the top wall 221 between the receiving sections 201, 203, and a separating member (24*b*) projects downwardly from the top wall 221 between the receiving sections 202, 204. The plate part 21 further has two additional pairs of through holes 211, and two additional holding grooves 25, 25' each having a groove bottom wall with a slanting surface 250, 250'. The slanting surface 250, 250' has opposite first and second ends 251, 252, 251', 252'. The slanting surface 250, 250' slants downwardly from the first end 251, 251' to the second end 252, 252'.

The rolling-ball switch 100 further comprises a pair of third terminals 42 extending into the receiving section 203 through a respective additional pair of the through holes 211 in the plate part 21 and disposed proximate to the first end 251 of the slanting surface 250, a pair of fourth terminals 42' extending into the receiving section 204 through another respective additional pair of the through holes 211 in the plate part 21 and disposed proximate to the first end 251' of the slanting surface 250', and two additional conductive balls (3*a*, 3*a*') disposed respectively in the receiving sections 203, 204 and rollable toward the respective pairs of the third and fourth terminals 42, 42' in a second direction (Y) that is transverse from the first direction (X).

In the absence of an external force, the conductive balls 3, 3', (3*a*), (3*a*') are disposed respectively in proximity to the second ends 232 (see FIG. 4), 232' (see FIG. 4), 252, 252' of the respective holding groove 23, 23', 25, 25'. Similarly, each separating member 24, 24', (24*a*), (24*b*) prevents the conductive balls 3, 3', (3*a*), (3*a*') from rolling from one of the receiving sections 201, 202, 203, 204 to the other one of the receiving sections 201, 202, 203, 204. The switch 100 is OFF in this state.

When an external force is applied to the switch 100 along the first direction (X), the conductive balls 3, 3' roll from the second ends 232, 232' toward the first ends 231 (see FIG. 4), 231' (see FIG. 4) so as to contact the respective pairs of the first and second terminals 41, 41', thereby shifting the switch 100 from the OFF state to an ON state. When an external force is applied to the switch 100 along the second direction (Y), the conductive balls (3*a*, 3*a*') roll from the second ends 252, 252' toward the first ends 251, 251' so as to contact the respective pairs of the third and fourth terminals 42, 42', thereby also shifting the switch 100 from the OFF state to an ON state.

Hence, whether the external force applied to the switch 100 is along the first direction (X) or the second direction (Y), or the switch 100 is tilted, the switch 100 according to the third preferred embodiment can be switched between ON and OFF states quickly, that is, in a highly sensitive manner.

Figure 10:
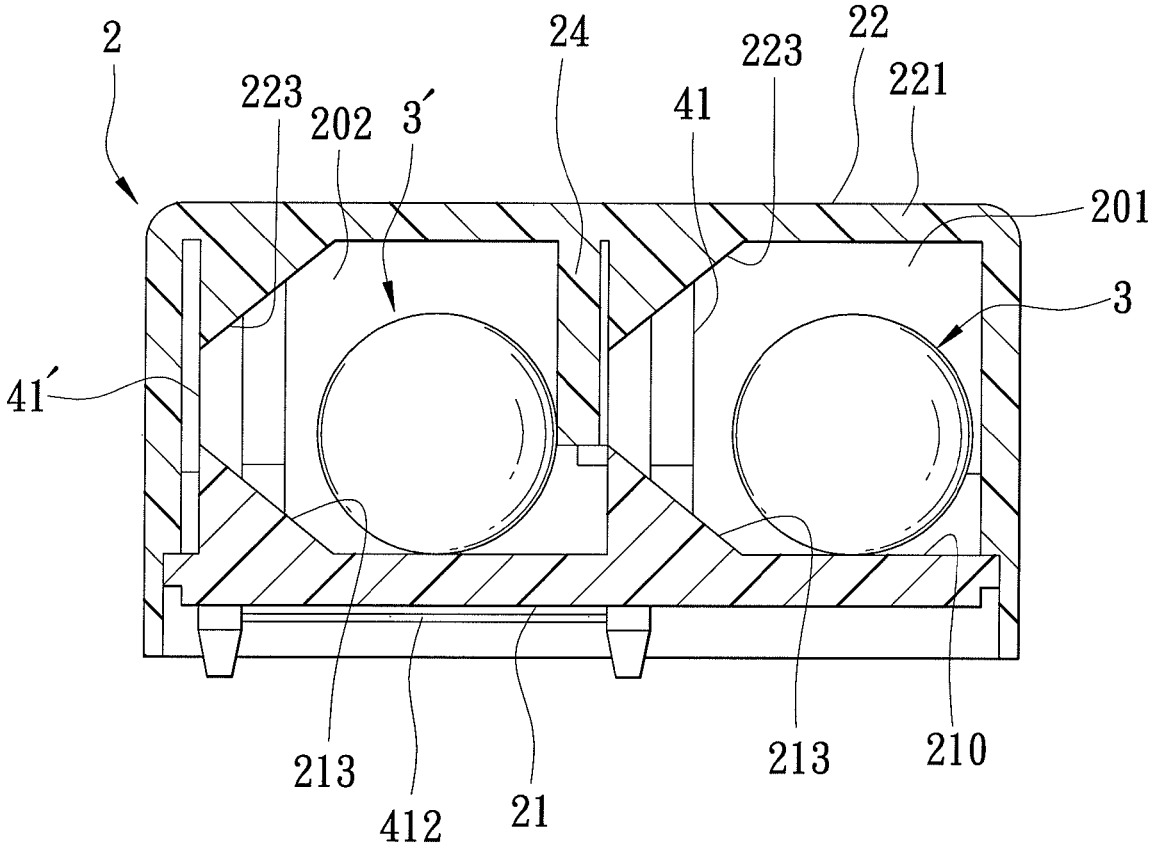
FIG. 10 is a sectional view of a rolling-ball switch according to the fourth preferred embodiment of this invention.

Referring to FIG. 10, a rolling-ball switch 100 according to the fourth preferred embodiment of the present invention is shown to be similar to the first preferred embodiment. However, in this embodiment, the plate part 21 is provided with two spaced-apart first inclined projections 213 projecting upwardly, inclinedly, and leftwardly from the inner surface 210 thereof, and the holding grooves 23, 23' (see FIG. 4) are dispensed herewith. The casing part 22 is provided with two spaced-apart second inclined projections 223 projecting downwardly, inclinedly, and leftwardly from the top wall 221. One of the second inclined projections 223 is adjacent to the separating member 24. Similarly, the conductive balls 3, 3' roll to contact the respective pairs of the first and second terminals 41, 41' in the presence of an external force so as to place the switch 100 in an ON state, and away from the respective pairs of the first and second terminals 41, 41' in the absence of an external force so as to shift the switch 100 from the ON state to an OFF state.

It is worth mentioning that each of the first terminals 41 may be connected to an adjacent one of the second terminals 41' through a conductive member 412. The conductive member 412 may be connected between one first terminal 41 and the adjacent second terminal 41' to form a substantially U-shaped connection, as shown in FIG. 10, where the conductive member 412 is disposed externally of the housing 2, or a substantially H-shaped connection (not shown), where the conductive member 412 is disposed within the housing 2. The first and second terminals 41, 41' may also be connected in series through a circuit board (not shown).

Hence, as long as one of the conductive balls 3, 3' is in contact with one pair of the first and second terminals 41, 41', the other pair of the first and second terminals 41, 41' can also conduct electricity through a series connection with the adjacent ones of the first and second terminals 41, 41'. Hence, ON/OFF operation of the switch 100 can be easily controlled.

Figure 11:
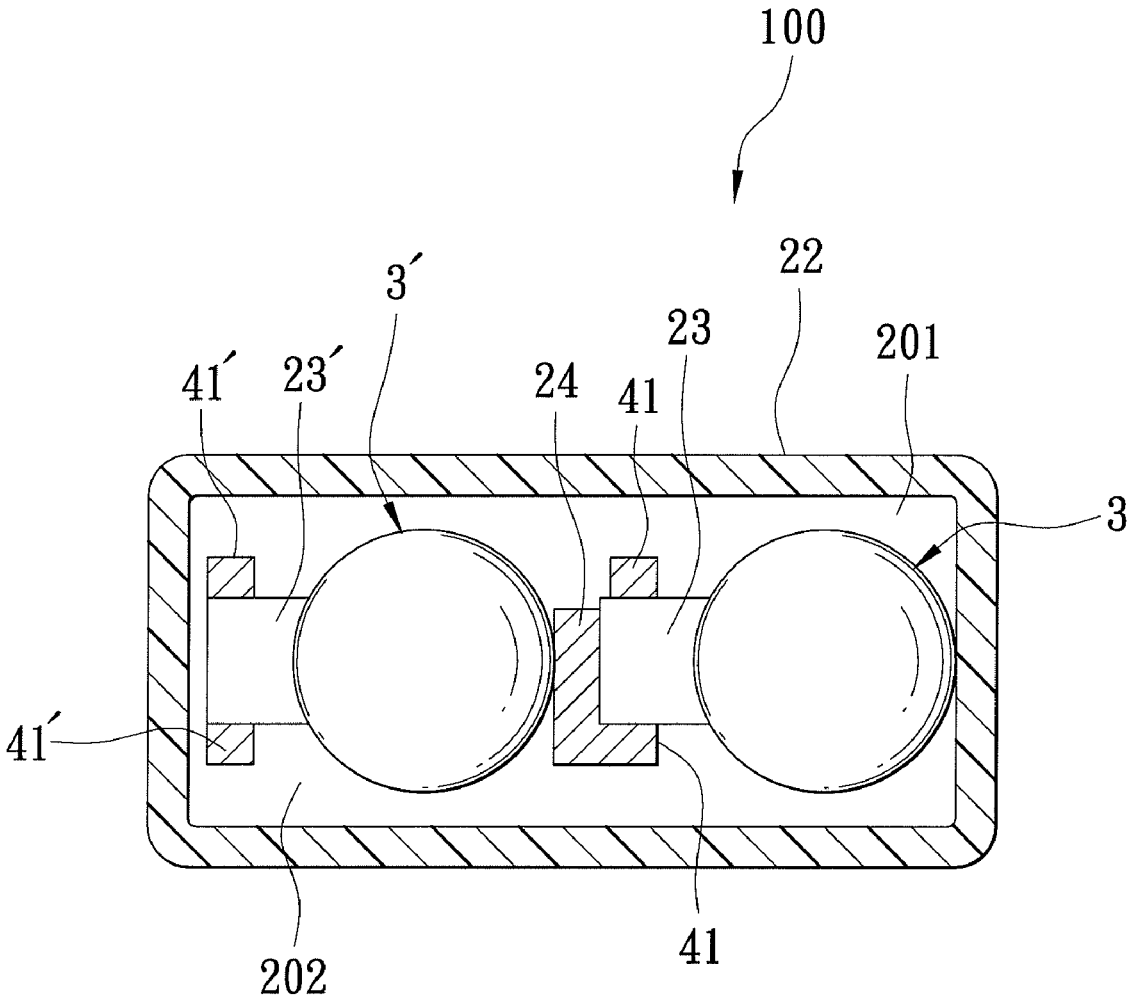
FIG. 11 is a sectional view of a rolling-ball switch according to the fifth preferred embodiment of this invention.

Referring to FIG. 11, a rolling-ball switch 100 according to the fifth preferred embodiment of the present invention is shown to be similar to the first preferred embodiment. However, in this embodiment, the separating member 24 is connected integrally to one of the first terminals 41, but is disconnected from the other one of the first terminals 41. The separating member 24 similarly extends between the receiving sections 201, 202. The advantages of the first preferred embodiment can be similarly achieved using the fifth preferred embodiment.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A rolling-ball switch comprising:

a housing defining at least two receiving sections and having a top wall, and a bottom wall provided with at least two slanting surfaces disposed respectively in said receiving sections;

at least one separating member provided in said housing and projecting downwardly from said top wall between said two receiving sections;

at least two conductive balls disposed respectively in said receiving sections and being respectively movable along said slanting surfaces;

a pair of first terminals extending into one of said receiving sections to contact one of said conductive balls; and a pair of second terminals extending into the other one of said receiving sections to contact the other one of said conductive balls;

said conductive balls being rollable toward the respective pairs of said first and second terminals in a first direction; and said separating member preventing movement of said conductive balls from one of said receiving sections to the other one of said receiving sections.

2. The rolling-ball switch of claim 1, wherein said housing includes a casing part having said top wall, and a plate part connected to and cooperating with said casing part to define said receiving sections, said plate part having said bottom wall.

3. The rolling-ball switch of claim 1, wherein each of said slanting surfaces has opposite first and second ends, each of said slanting surfaces slanting from said first end to said second end, each of said conductive balls being proximate to said second end of the respective said slanting surface when moving away from the respective pair of said first and second terminals.

4. The rolling-ball switch of claim 1, wherein said separating member is connected to one of said first and second terminals.

5. The rolling-ball switch of claim 1, wherein each of said first terminals is connected to a respective one of said second terminals through a conductive member.

6. A rolling-ball switch comprising:

a housing defining at least two receiving sections;

at least one separating member provided in said housing between said two receiving sections;

at least two conductive balls disposed rollably and respectively in said receiving sections;

a pair of first terminals extending into one of said receiving sections to contact one of said conductive balls; and a pair of second terminals extending into the other one of said receiving sections to contact the other one of said conductive balls;

said conductive balls being rollable toward the respective pairs of said first and second terminals in a first direction; and said separating member preventing movement of said conductive balls from one of said receiving sections to the other one of said receiving sections, wherein said housing further defines two additional receiving sections, said rolling-ball switch further comprising a pair of third terminals, a pair of fourth terminals, and two additional said conductive balls disposed respectively in said two additional receiving sections and rollable toward the respective pairs of said third and fourth terminals in a second direction that is different from said first direction.

7. A rolling-ball switch comprising:

a housing defining at least two receiving sections connected spatially to each other;

at least one separating member provided in said housing between said two receiving sections;

at least two conductive balls disposed rollably and respectively in said receiving sections;

a pair of first terminals extending into one of said receiving sections to contact one of said conductive balls; and a pair of second terminals extending into the other one of said receiving sections to contact the other one of said conductive balls, wherein both of said conductive balls roll to the respective pairs of said first and second terminals by moving in a first direction;

said separating member prevents movement of said conductive balls from one of said receiving sections to the other one of said receiving sections;

said receiving sections are aligned with each other in said first direction;

said first terminals are aligned with each other in a direction transverse to said first direction;

said second terminals are aligned with each other in the same direction as said first terminals; and one of said conductive balls is disposed between the pairs of said first and second terminals.

8. The rolling-ball switch of claim 7, wherein said housing has a top wall and a bottom wall, said separating member projecting downwardly from said top wall between said receiving sections and being spaced apart from said bottom wall.

* * * * *